United States Patent [19]

Anzai et al.

[11] Patent Number: 4,837,478

[45] Date of Patent: Jun. 6, 1989

[54] NEAR-INFRARED RAY RADIATION ILLUMINATOR AND NEAR-INFRARED RAY IMAGE PICK-UP DEVICE

[75] Inventors: Yoshinori Anzai, Zushi; Takao Saikatsu, Kamakura; Masato Saito, Kamakura; Michihiro Tsuchihashi, Kamakura, all of Japan

[73] Assignee: Mitsubishi Denki Kabushiki Kaisha, Tokyo, Japan

[21] Appl. No.: 132,664

[22] Filed: Dec. 10, 1987

[30] Foreign Application Priority Data

May 9, 1984 [JP] Japan ..... 59-92098
May 9, 1984 [JP] Japan ..... 59-92099

[51] Int. Cl.[4] ..... H01J 61/16; H01J 61/35
[52] U.S. Cl. ..... 313/112; 313/489
[58] Field of Search ..... 313/112, 491, 493, 640, 313/643, 489; 362/293; 250/341, 342

[56] References Cited

U.S. PATENT DOCUMENTS

| | | | |
|---|---|---|---|
| 2,624,238 | 1/1953 | Widdop et al. | 350/1.6 |
| 3,252,036 | 5/1966 | Elmer et al. | 313/636 X |
| 3,324,329 | 6/1967 | Koda | 313/112 X |
| 3,407,322 | 10/1968 | Saum | 313/385 X |
| 4,005,330 | 1/1977 | Glascock, Jr. et al. | 313/493 X |
| 4,020,377 | 4/1977 | Popp et al. | 313/571 X |
| 4,346,323 | 8/1982 | Hirschfield | 313/112 X |
| 4,393,331 | 7/1983 | Dobrusskin et al. | 313/112 X |
| 4,425,527 | 1/1984 | Sichel | 313/112 |
| 4,500,784 | 2/1985 | Hacskaylo | 250/341 |
| 4,500,810 | 2/1985 | Graff | 313/489 X |

FOREIGN PATENT DOCUMENTS

| | | | |
|---|---|---|---|
| 678345 | 1/1964 | Canada . | |
| 1121903 | 12/1977 | Canada . | |
| 1931573 | 7/1970 | Fed. Rep. of Germany . | |
| 2208844 | 9/1973 | Fed. Rep. of Germany | 313/112 |
| 45-36996 | 11/1970 | Japan . | |
| 47-36563 | 11/1972 | Japan . | |
| 48-18085 | 3/1973 | Japan . | |
| 56-167252 | 12/1981 | Japan . | |
| 8100677 | 3/1980 | World Int. Prop. O. . | |

OTHER PUBLICATIONS

"The Journal of Japan Society of Illumination Technology", vol. 43, No. 1, pp. 21 to 28, 1959.
Japanese Examined Patent Publication No. 42436/1976 published on Nov. 16, 1976, Corresponding to U.S. Ser. No. 378,286 filed on Jul. 11, 1973.
Journal of IES, Apr. (1974), pp. 234 to 236.
Japanese Unexamined Patent Publication No. 167252/1981 Published on Dec. 22, 1981 and the Corresponding U.S. Pat. No. 4,393,331.
Japanese Unexamined Patent Publication No. 18085/1973 published on Mar. 7, 1973.
Infrared Radiation, Henry L. Hackforth. The Various Types of Radiation Sources Are Classified and Their Uses Are Described.

*Primary Examiner*—Leo H. Boudreau
*Assistant Examiner*—K. Wieder
*Attorney, Agent, or Firm*—Oblon, Fisher, Spivak, McClelland & Maier

[57] ABSTRACT

The invention is concerned with an illuminator to radiate light rays in the near-infrared region, and a near-infrared ray image pick-up device which irradiates the near-infrared light radiated from this illuminator onto an object to be pictured, and captures light reflected from the object for image pick-up. By constructing the illuminator with an electric discharge lamp and a filter which removes the visible region and permit the near-infrared region to pass therethrough out of light rays radiated from this electric discharge lamp, there can be provided a near-infrared ray radiation illuminator having a high efficiency and low deterioration characteristic. And, at the same time, by constructing a near-infrared ray image pick-up device with this near-infrared ray radiation illuminator and an image pick-up device which captures reflected light of the near-infrared ray radiated from the illuminator to be irradiated onto the object for the image pick-up, the image pick-up can be done without notice of a human being, whereby, when the device is used as a crime-preventing monitoring device, the monitoring of an intruder can be done perfectly, and, when it is used as a visitor congnition device, there is no disagreeable feeling on the part of the visitor by his being dazzled by illuminating light or his knowledge of being pictured by the device.

4 Claims, 4 Drawing Sheets

NEAR-INFRARED RAY RADIATION ILLUMINATOR AND NEAR-INFRARED RAY IMAGE PICK-UP DEVICE

This application is a continuation of application Ser. No. 744,000, filed on May 24, 1985, now abandoned.

FIELD OF TECHNOLOGY

This invention is concerned with an illuminator which radiates light rays in the near-infrared region, and with a near-infrared ray image pick-up device which irradiates onto an object for image pick-up near-infrared ray radiated from this illuminator and picks up an image by capturing reflected light from the object.

BACKGROUND OF TECHNOLOGY

So far, an illuminating device has been, in general, of such a type that performs radiation of light rays concentratedly in the visible part of the light rays. And, in the image pick-up device using a television camera, the image pick-up operation is done under illumination of light radiating from the visible part of the light rays.

However, in the image pick-up method using the light rays in the visible part, there take place various inconveniences owing to an object and the image pick-up device being seen during the image pick-up operation.

For example, in various crime-preventing monitoring devices and visitor c ›ngnition devices installed in shops, banks, factories, residences, and so on, there has been adopted a method, in which the image pick-up operation is done by capturing visible light rays from an object (for image pick-up) which has been irradiated with luminous light in the visible part of light by means of a video-camera, and displaying video signals thereof on a Braun tube of a television set, or inputting the video signals in a video tape for later reproduction of the picked-up image.

Accordingly, in the crime-preventing monitoring device, an intruder is able to readily recognize existence of the monitoring device, which is disadvantageous. Also, in the visitor congnition device installed at the main gate or rear gate of a house, there are such disadvantages that the visitor is dazzled by the illuminating light, or feels displeasure at his knowledge of being pictured by a camera.

Thus, in the conventional image pick-up device which picks up images under visible light, the above-described disadvantages were unavoidable.

Also, as described in "The Journal of Japan Society of Illumination Technology", No. 43, Vol. 1, pp 21 to 28, there has been known a noctovision, etc., which projects near-infrared rays onto an object, then amplifies light reflected from the object, and observes the object with naked eyes through an image tube. This, however, is not an image pick-up device, but is used for particular purposes, which is therefore not a general purpose device.

On the other hand, as a light source for emitting light in the near-infrared part of the light, there has been one, in which an incandescent electric bulb is covered with an appropriate filter. However, owing to inferiority in illuminating efficiency of the incandescent electric bulb and the absorbing effect of the filter, the light emitting efficiency in the near-infrared region was so poor as to constitute a problem. On account of this, attempt has been made as to obtaining near-infrared light emission with a fluoroscent lamp which has higher light emitting efficiency than the incandescent electric bulb. For instance, as described in Japanese Examined Patent Publication No. 42436/1976 and Journal of IES, April (1974), pp 234 to 236, there can be obtained a near-infrared light emitting fluorescent lamp having its light emitting wavelength region of from 650 to 900 nm, with its peak being in the vicinity of 740 nm, by use of iron-added lithium aluminate fluorescent material. While, however, this fluorescent lamp is excellent in its higher light emitting efficiency in the near-infrared region than that of the incandescent electric bulb, it has such disadvantage that the fluorescent material thereof becomes deteriorated with lighting and its light output lowers abruptly.

DISCLOSURE OF THE INVENTION

The present invention is to provide a near-infrared ray radiation illuminator which utilizes an electric discharge lamp as a light source, and is provided with a filter which causes the near-infrared region of light radiated from the electric discharge lamp to pass through it and removes light in the visible region, thereby eliminating light emission in the visible light region and retaining light emission in the near-infrared region alone, and, at the same time, to provide a near-infrared ray image pick-up device which, by use of this near-infrared ray radiation illuminator, catches the reflected light of the near-infrared light, which has been radiated from this illuminator onto an object for image pick-up, by means of the image pick-up device having its sensitivity in the near-infrared ray region and functioning for the image pick-up.

According to the present invention, since the electric discharge lamp is used as the light source, the light emitting efficiency is not so poor as in the incandescent electric bulb; and, also, since a filter is used instead of a fluorescent material, the illuminator has its own effects such that it has a high light emitting efficiency and low deterioration characteristics, by which abrupt decrease in the light output due to deterioration of the fluorescent material can be avoided, and yet has a general characteristic such that radiation of light is not perceived by human beings.

Further, since the image pick-up device utilizes the near-infrared ray which is not perceived by human beings, when the device is used as the crime-preventing monitoring device, no light is noticed in the dark at night, so that the intruder has no knowledge of the presence of this crime-preventing monitoring device, and he would not avoid such monitoring device. Therefore, it is possible to pick up the image of the intruder without being noticed by him, hence the device can sufficiently carry out its role of the monitoring device.

Furthermore, when it is used as the visitor congnition device installed at the main entrance or the rear entrance of a house, there is no possibility of the visitor being dazzled by illuminating light or feeling displeasure, because of his unawareness of being pictured by the camera, and other advantages.

THE BEST MODE TO PRACTICE THE INVENTION

Figure 1:
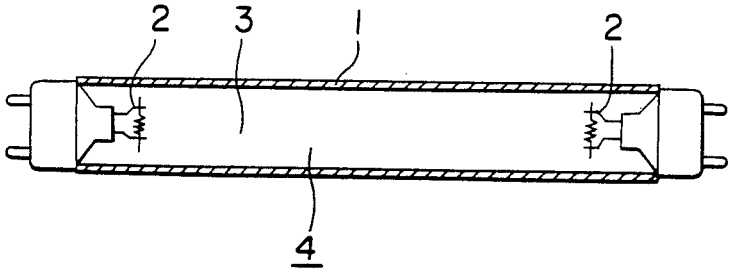
FIG. 1 is a structural diagram of a near-infrared light emitting low pressure rare gas electric discharge lamp as one embodiment of the near-infrared light emitting illuminator according to the present invention.

FIG. 1 illustrates the near-infrared low pressure rare gas electric discharge lamp as one embodiment of the near-infrared ray radiation illuminator according to the present invention. In the drawing, a numeral 1 refers to an electric discharge lamp having a tube bore of 26 mm and a tube length of 436 mm, the discharge tube being made of filter glass which is prepared by mixing in the lead glass an absorbing agent such as molybdenum oxide ($MnO_2$), chromium oxide ($Cr_2O_3$), and so forth, has its transmission rate of the visible light range of substantially zero, has its transmission rate of near-infrared light of 15% or lower at the wavelength of 750 nm, and has its rising transmission characteristic with the near-infrared ray transmission rate of 0.8T% or higher at the wavelength of 810 nm, when the maximum transmission rate at the wavelength range of from 750 to 1000 nm is taken as T%. Numerals 2, 2 refer to a pair of electrodes which are sealed in at both ends of the filter-glass-made electric discharge lamp 1. A numeral 3 refers to a mixed rare gas of Ar (50%) and Ne (50%) filled in the above-mentioned electric discharge lamp 1 under a pressure of 3.5 Torr.

By the way, no fluorescent material is coated on the above-mentioned discharge tube.

In the low pressure rare gas electric discharge lamp thus constructed, the light emission in the visible region is eliminated by the filter glass having the above-mentioned characteristics and forming the discharge tube, and becomes too low to be almost perceived by human beings Also, the discharge lamp shows its emission characteristic which is concentrated on the near-infrared region of a wavelength range of from 750 to 1000 mn with the wavelength of 810 nm and its vicinity as the principal wavelength thereof owing to the filled rare gas with argon as the principal gas and the above-mentioned filter glass.

Further, those near-infrared low pressure rare gas electric discharge lamp having various near-infrared region transmitting characteristics were manufactured by varying the quantity of the absorbing agent such as molybdenum oxide ($MnO_2$), chromium oxide ($Cr_2O_3$), etc. to be mixed into the filter glass to form the discharge tube 1. These discharge lamps were measured for their light transmission rising characteristic at the near-infrared region, its relative light output at the wavelength range of from 750 to 1000 nm, and sensitivity of the filter. The results as shown in Table 1 below were obtained.

In Table 1 below, the rising characteristic of the filter is shown in terms of the transmission rate at the wavelengths of 750 nm and 810 nm, and the sensitivity is evaluated visually by a degree of coloring on the wall of the discharge lamp, in which a mark indicates "sensible"; a mark indicates "slightly sensible", and a mark indicates "substantially non-sensible".

TABLE 1

| Sample No. | Transmission Rate of Filter Glass (%) 750 mn | 810 mn | Relative Near-Infrared Ray Output (750 to 1000 mn) | Sensitivity |
|---|---|---|---|---|
| 1 | 24 | 88 | 100 | Δ |
| 2 | 20 | 87 | 97 | Δ~ |
| 3 | 15 | 85 | 96 | ~ |
| 4 | 11 | 83 | 93 | |
| 5 | 4 | 78 | 87 | |
| 6 | 0 | 75 | 80 | |
| 7 | 0 | 69 | 69 | |

Figure 2:
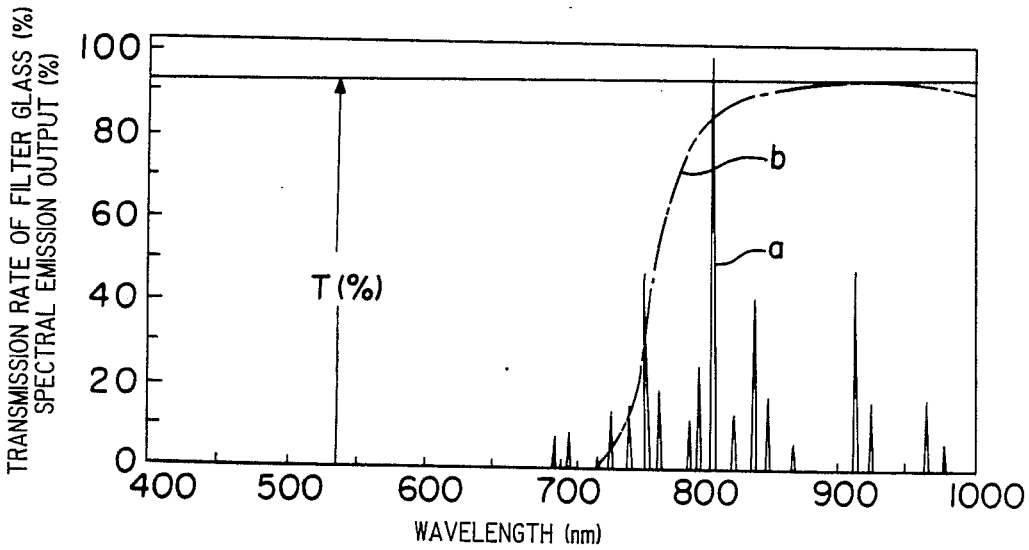
FIG. 2 is a graphical representation showing the filtering characteristic and the spectral emission characteristic of the electric discharge tube.

Also, the light output is indicated in terms of relative emission output at the wavelength range of from 750 to 1000 nm. FIG. 2 shows a spectral emission distribution (curve a) of this discharge lamp, and one example of a light transmission rising characteristic (curve b) of the glass tube with a filter provided on it. From Table 1 above and FIG. 2, it was found that the filter glass may have the characteristics of intercepting the visible light and of permitting the near-infrared region of light to transmit therethrough, and that, in order to make the light emission to be visually inperceptible, the transmission rate of the filter glass should preferably be made lower than 15% at the wavelength of 750 nm. The reason for this is that, while the low pressure rare gas electric discharge lamp has its principal light emission at the wavelength of 810 nm or in its vicinity, it still has light emission to some extent even at the wavelength below 760 nm or in its vicinity. Moreover, when a filter having a steep transmission rising characteristic is used with a view to lowering the sensitivity, the light transmission rate at the wavelength of 810 nm also decreases with the consequence that the near-infrared ray output lowers to render the discharge lamp to be of poor light emission efficiency.

Accordingly, the transmission rising characteristic of the filter glass for use in the discharge tube should desirably be such that its transmission rate at the wavelength of 750 nm may be 15% or below, and its transmission rate at the wavelength of 810 nm may be 75% and above.

Of the light transmission rising characteristics of the filter glass, the transmission rate at the wavelength of 810 nm depends on the kind of the absorbing agent for use in the filter glass and its quantity of use. The quantity should desirably be 0.8 times as high as that of the maximum transmission rate T% of the filter glass at the near-infrared ray wavelength range of from 750 to 1000 nm, as shown in FIG. 2.

Further, in place of argon as the rare gas to be filled in the discharge lamp, krypton and xenon were used in practice. The same results as in the above-described example were obtained for the light transmission rising characteristic of the filter glass.

Figure 3:
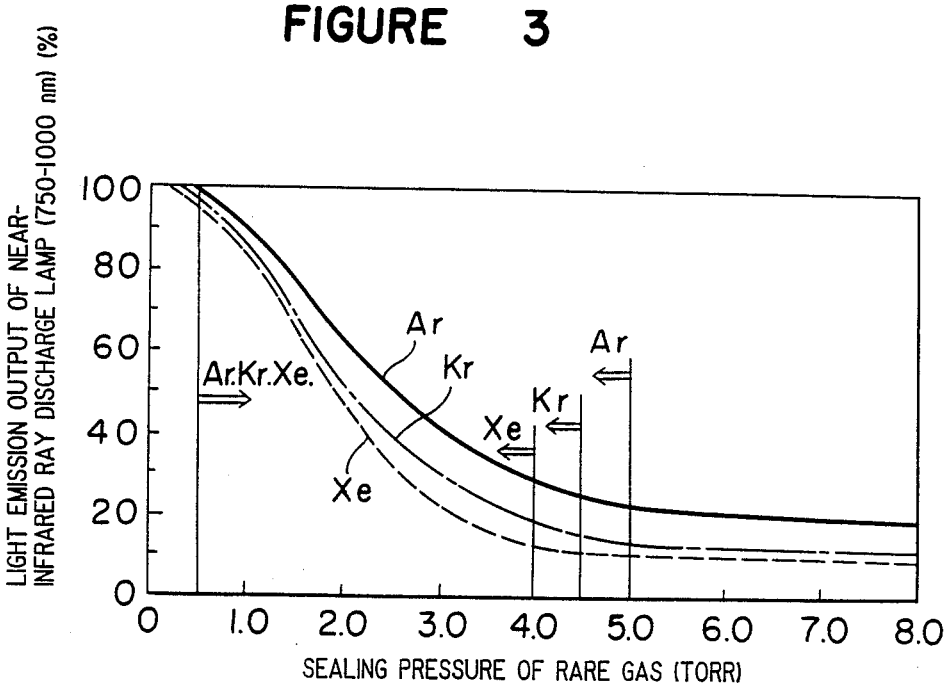
FIG. 3 is a characteristic diagram showing a relationship between a filling pressure of each rare gas of Ar, Kr, and Xe and an emission output at the wavelength range of from 750 to 1000 nm of the near-infrared light emitting low pressure rare gas electric discharge lamp.

Furthermore, using the same discharge tube as in the above-described examples, the low pressure rare gas electric discharge lamps having the tube length of 436 mm were manufactured, wherein the rare gases of xenon, krypton, and argon were filled at varying pressure ranges of from 0.1 to 0.8 Torr. Then, measurements were conducted to find out how the near-infrared ray output at the wavelength range of from 750 to 1000 nm changes depending on the kind of the gas and its filling pressure, and the results as shown in FIG. 3 were obtained. The near-infrared ray transmission characteristics of the glass discharge tubes used were 4% at the wavelength of 750 nm, and 81% at the wavelength of 810 nm.

FIG. 3 shows a relationship between the near-infrared ray emission output at the 20 watt of the discharge tube and the filling pressure of each rare gas used. An arrow mark indicates the optimum, practical range of the filling pressure.

From FIG. 3, it was verified that the discharge lamps, in which argon is filled at the filling pressure of 5.0 Torr or below, krypton at the filling pressure of 4.5 Torr or below, and xenon at the filling pressure of 4.0 Torr or below attained the near-infrared light emission with high efficiency. However, when the filling pressure was 0.5 Torr or below, there was observed wear of the electrodes in any of the discharge lamps in a short period of time after they were lighted, which raised a practical problem to some extent. Accordingly, it is preferable that the rare gas such as argon, krypton, and xenon to be filled in the low pressure rare gas electric discharge lamp be at the under-mentioned pressure ranges.

5.0 Torr > Ar > 0.5 Torr 4.5 Torr > Kr > 0.5 Torr 4.0 Torr > Xe > 0.5 Toı.

Incidentally, the near-infrared light emitting low pressure rare gas electric discharge lamp is not limited to that, in which argon, xenon, or krypton is used singly, but also the low pressure rare gas electric discharge lamp, in which other gas such as, for example, neon, helium, and so on is mixed with each rare gas such as argon, krypton or xenon, may equally be used.

Moreover, the glass for the discharge tube is not limited to the filter glass, in which the absorbing agent such as molybdenum oxide ($MnO_2$), chromium oxide ($Cr_2O_3$), etc. is mixed with lead glass, but it may include those, in which the outer peripheral surface of the transparent glass tube is covered with a plastic filter tube having a slightly larger outer diameter than that of the glass tube, and which is made of methacrylic resin mixed and dispersed therein with an absorbing agent capable of absorbing visible light rays such as inorganic pigments and organic pigments and causing the near-infrared ray to transmit therethrough, or in which the outer peripheral surface of the transparent glass tube is covered with a heat-shrinking plastic filter tube, or in which the outer peripheral surface of the transparent glass tube is coated with a paint which permits the near-infrared resion of light to pass through it, but intercepts the visible region of the light.

In addition, the discharge tube is not limited to that constructed with the filter glass, but also it may be constructed in such a manner that a filter such as filter glass, plastic filter, and so forth is fitted at the opening part for the light emission from the discharge lamp.

Figure 4:
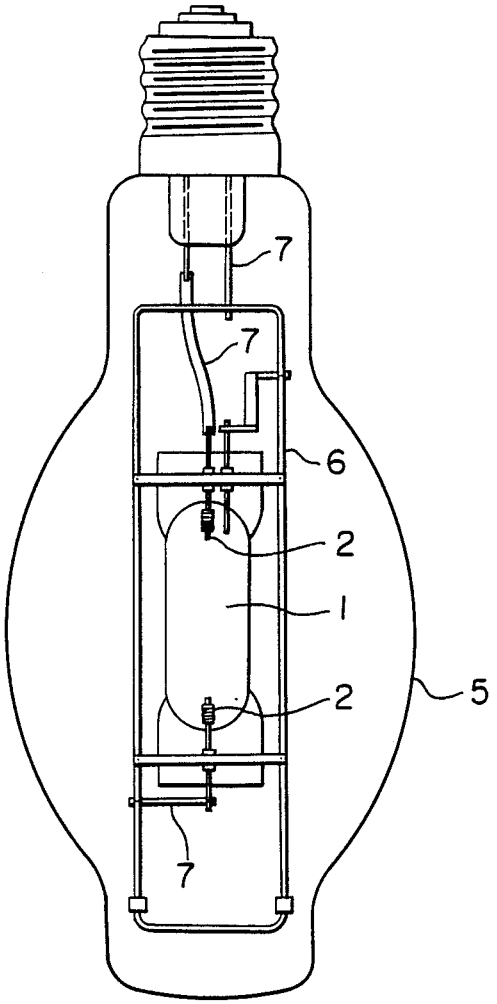
FIG. 4 is a structural diagram of a near-infrared ray radiating metal halide lamp showing another embodiment of the near-infrared light emitting illuminator according to the present invention.

FIG. 4 shows a near-infrared light emitting metal halide lamp as the near-infrared light radiation illuminator according to another embodiment of the present invention. A predetermined quantity of argon and mercury, to which cesium iodide (CsI) is added, is filled inside the quartz light emitting tube 1 having a pair of electrodes 2, 2 provided at both ends thereof. The outer tube 5 is made of a filter glass having the visible light transmission rate of substantially zero, and a high near-infrared ray transmission rate. The outer tube is provided for removing radiation of the visible light region from the light emitting tube. The other purpose of the outer tube 5 is to protect from air, especially oxygen those member, i.e., the supporting frame 6 and leads 7, installed within the light emitting tube 1 and the outer tube 5.

When the metal halide lamp according to the present invention, in which the above-mentioned CsI is enveloped inside the light emitting tube, is lighted with use of an appropriate lighting device, a spectrum is emitted concentratedly from the near-infrared region of the wavelength range of from 750 to 1000 nm in its stabilized lighted condition. The visible light emission from the light emitting tube is removed by the outer tube 5 made of the filter glass, hence the visible light emission is extremely low and substantially no visible light emission is effected.

In the above-described example, mention has been made of the metal halide lamp using argon and mercury added with cesium iodide (CsI). It should, however, be noted that the usable metal is not limited to Cs, but at least one kind of Li, Na, K, Rb, Zn, Cd, Al, Ga, In Tl, Ge, Sn, Pb, Fe, and rare earth metals (Sc, lanthanoids, and actinoids) may be used in the form of metal or metal halide. The halogen is not limited to iodine (I), but also chlorine (Cl) and bromine (Br) may be used.

Further, quartz is used as the material for the light emitting tube, which may be replaced by polycrystalline alumina, sapphire, yttrium, and others. Furthermore, as the rare gas, use is made of argon. But, the gas is not limited to argon alone, but also He, Ne, Kr, Xe, etc. may be used singly or in combination of two or more kinds of them.

In the above-described examples, the outer tube is constructed with the filter glass, although it is not limited to filter glass, but also use may be made of transparent glass, on which a plastic filter, etc. is convered to give a filter effect.

Figure 5:
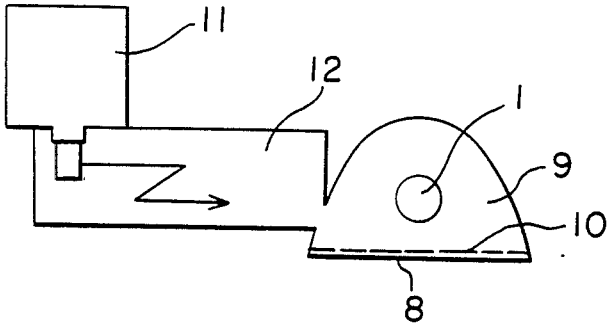
FIG. 5 a structural diagram of a near-infrared ray radiating micro-wave light source device showing other embodiment of the near-infrared light emitting illuminator according to the present invention.

FIG. 5 illustrates a near-infrared radiation micro-wave light source device using the near-infrared ray radiation illuminator as the other embodiment of the present invention. In the interior of a micro-wave cavity resonator 9 having a front glass 8 made of filter glass having the visible light transmission rate of substantially zero and a high near-infrared light transmission rate, there is accommodated a spherical quarts electrodeless light source tube 1, in which a predetermined quantity of argon and mercury added with cesium iodide (CsI) is filled. The front glass 8 made of filter glass is provided for removing the visible light radiation from the light source tube 1. Also, in front of the micro-wave cavity resonator 9, there is disposed a metal mesh 10 which reflects micro-waves, but causes light to pass through it. The inner surface of the cavity resonator 9 is made reflective. A reference numeral 11 designates a magnetron, and a numeral 12 refers to a wave-guide.

When the electrodeless light source tube according to the present invention, in which the above-mentioned CsI is filled, is installed at a predetermined position within the micro-wave cavity resonator 9, and lighted with micro-waves generated in the magnetron 11, led by the wave-guide 12, and introduced into the micro-wave cavity resonator, a spectrum is concentratedly radiated from the near-infrared region having the wavelength range of from 750 nm to 1000 nm in its stabilized lighted condition. Radiation of the visible light from the light source tube 1 is removed by the front glass 8 constructed with the filter glass, and the visible light emission becomes extremely low. As the consequence of this, the micro-wave discharge light source device, in which CsI is used as the light emitting substance, does not emit the visible light rays to a substantial extent.

The micro-wave discharge light source tube, different from the ordinary high pressure discharge lamp, is excellent in its starting characteristic and re-starting characteristic, hence it becomes stabilized in an extremely short period of time and can also be re-started in an extremely short period of time.

In the above-described example, mention has been made of the electrodeless light source tube using argon and mercury added with CsI. However, metal that can be used is not limited to Cs, but also at least one kind of Li, Na, K, Rb, Zn, Cd, Al, Ga, In, Tl, Ge, Sn, Pb, Fe, and rare earth metals (Sc, Y, lanthahoids, and actinoids) may be used in the form of metal or metal halide. The halogen is not limited to iodine (I), but also chlorine (Cl) and bromine (Br) may be used.

Further, quartz is used as the material for the light source tube, but use may also be made of polycrystaline alumina, sapphire, yttrium, and so on. As the rare gas, argon is used, but the gas is not limited to argon, but also He, Ne, Kr, Xe, etc. may be used singly or in combination of two or more kinds of them.

Furthermore, in the above-described example, filter glass is used as the filter. The filter is not limited to filter glass, but also a filter made of plastic may be used, provided that it is able to remove the visible light and permits the near-infrared ray to pass through it.

Figure 6:
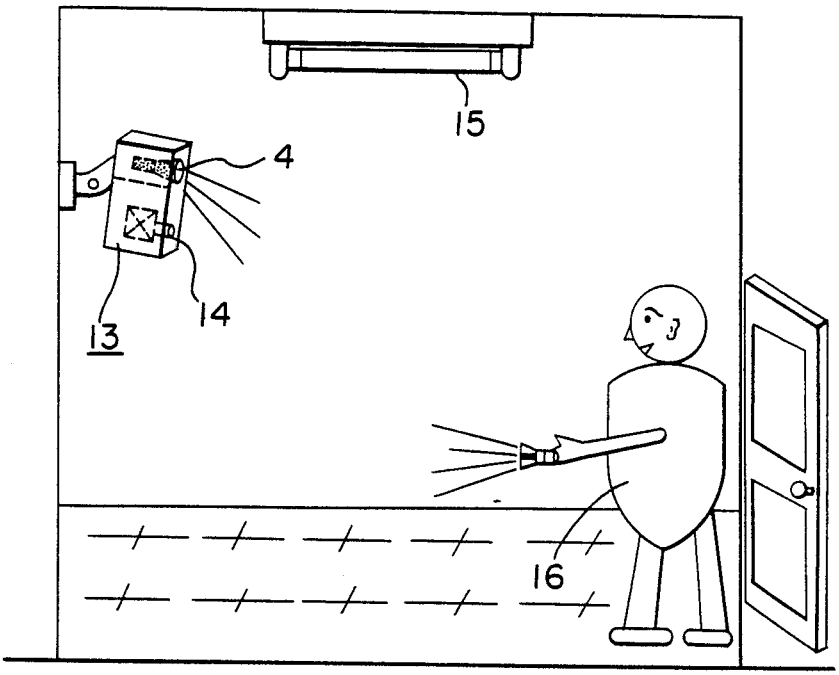
FIG. 6 is a system diagram of a crime-preventing device, to which one embodiment of the near-infrared ray image pick-up device according to the present invention is applied.

FIG. 6 is a schematic system diagram showing one embodiment of the present invention, in which the near-infrared ray image pick-up device is applied to the crime-preventing monitoring device. This crime-preventing monitoring device 13 is provided with the near-infrared light emitting low pressure rare gas electric discharge lamp 4 as the near-infrared ray radiation illuminator and a near-infrared ray camera 14 as the image pick-up device provided with the solid-state image pick-up element having its sensitivity in the near-infrared region. A numeral 15 refers to a general fluorescent lamp which radiates visible light, and a numeral 16 refers to an intruder.

The above-mentioned near-infrared camera 14 is composed of a lens to cause the near-infrared light to pass therethrough, an aperture to adjust exposure light quantity, and an image pick-up element having a high sensitivity at the wavelength range of from 750 to 1000 nm, in particular, at the wavelength range of from 800 to 900 nm which is the principal light emitting region of the above-mentioned near-infrared light emitting low pressure rare gas electric discharge lamp 4, and an image control circuit which amplifies and controls signals from the image pick-up element and outputs the controlled signals to an external monitor television or an image recording device. The image pick-up element is constructed with a silicon pn-junction type or a Schottky type light receiving element, and a signal transmission unit such as an MOS type transistor or a charge transfer device, which takes out the image pick-up signals from these light receiving element to outside.

In the case of the crime-preventing monitoring device of such construction, there is no need of lighting the fluorescent lamp 15 for the general illuminating purpose which emits light in the visible light region even at night, and, instead, the near-infrared light emitting low pressure rare gas electric discharge lamp 4 is lighted with all the lighting devices being extinguished. In this type of discharge lamp 4, since the discharge tube is formed of filter glass which intercepts the visible light and causes the near-infrared ray to pass therethrough, the total darkness can be secured without the near-infrared ray being almost perceptible to the human eyes, hence the presence of the crime-preventing monitoring device is not noticed by an intruder Therefore, the intruder 16, without knowledge of his being monitored by the device, steps inside defenselessly with a torch-light in his hand for lighting his way. This crime-preventing monitoring device 13 illuminates the intruder 16 by means of the near-infrared light emitting low pressure rare gas electric discharge lamp 4, and the light reflected from the intruder is received by the near-infrared camera 14 to thereby pick-up his image. Therefore, the intruder 16 can be pictured without his notice to it, and yet, since the near-infrared light emitting low pressure rare gas electric discharge lamp 4 radiates the near-infrared light with high efficiency, the device as a whole can be made small in size, and produces an effect different from illumination under the visible light.

Incidentally, the near-infrared camera 14 is not limited to the solid-state image pick-up element, but also any other types of element having sensitivity at a wavelength range of from 750 to 1000 nm, although desirable is a near-infrared camera incorporating in it an image pick-up tube or the solid-state image pick-up element as in the above-described example, which is highly sensitive to the wavelength range of from 800 to 900 nm as the principal light emission range of the near-infrared light emitting low pressure rare gas electric discharge lamp.

Incidentally, in the above-described embodiments, the near-infrared image pick-up device is constructed with combination of the near-infrared light emitting low pressure rare gas electric discharge lamp 4 and the near-infrared camera 14. However, the invention is not limited to this construction alone, but the near-infrared light emitting low pressure rare gas electric discharge lamp and the near-infrared camera may be separately provided.

Further, the near-infrared ray radiation illuminator is not limited to the near-infrared light emitting low pressure rare gas electric discharge lamp, but also various illuminators as explained in the foregoing may be used as a matter of course.

By the way, it goes without saying that the present invention includes every type of image pick-up devices, in which the near-infrared ray radiated from the near-infrared ray radiation illuminator and reflected by the surface of the illuminated object is caught by the near-infrared camera to be visualized.

We claim:

1. A near-infrared ray radiation illuminator comprising:

a low pressure rare gas electric discharge lamp which is provided with a discharge tube having a plurality of electrodes, and a filter which permits the near-infrared region to pass therethrough and removes the visible region out of the light rays radiated from said electric discharge lamp, wherein at least any one kind of said rare gases is filled in said discharge tube under the following pressure range:

5.0 Torr > Ar > 0.5 Torr 4.5 Torr > Kr > 0.5 Torr 4.0 Torr > Xe > 0.5 Torr and wherein said rare gas is excitable so as to produce a light omission.

2. The near-infrared ray radiation illuminator according to claim 1, characterized in that said filter has a transmission rate of 15% or lower at the wavelength of 750 nm, and a rising transmission characteristic with its transmission rate of 0.8T% or higher at the wave length of 810 nm, when the maximum transmission rate at the wave length range of from 750 to 1000 nm is taken as T%.

3. A near-infrared image pickup device for use in conjunction with the near-infrared radiation illuminator of claim 1, comprising:

a pickup element having a peak sensitivity in the wavelength range of 800 to 900 nm.

4. A near-infrared ray radiation illuminator comprising:

a high pressure discharge lamp having an outer tube and a high pressure light emitting tube disposed inside said outer tube and an image pick-up device having its sensitivity in the near-infrared region of light, and capturing reflected light of the near-infrared light radiated from said illuminator onto an irradiated object and reflected by it, wherein said high pressure light emitting tube at least one kind of Li, Na, K, Rb, Cs, Zn, Cd, Al, Ga, In, Tl, Ge, Sn, Pb, Fe, and rare earth metals filled therein in the form of metal or metal halide, in addition to said rare gas and mercury, and said outer tube is constructed with a filter substance which has a transmission rate of 15% or lower at the wave length of 750 nm, and a rising transmission characteristic with its transmission rate of 0.8T% or higher at the wavelength of 810 nm, when the maximum transmission rate at the wavelength range of from 750 to 1000 nm is taken as T%.

* * * * *

UNITED STATES PATENT AND TRADEMARK OFFICE

CERTIFICATE OF CORRECTION

PATENT NO. : 4,837,478

DATED : June 6, 1989

INVENTOR(S) : Yoshinori ANZAI, et al

It is certified that error appears in the above-identified patent and that said Letters Patent is hereby corrected as shown below:

On the Title Page, Item [75], the second inventor's name is incorrect. It should read as follows:

--Takeo Saikatsu--

Item [62], the related U.S. Application Data has been omitted, it should read as follows:

--Continuation of Serial No. 744,000 filed May 24, 1985, now abandoned.--

Signed and Sealed this

Eighth Day of May, 1990

*Attest:*

HARRY F. MANBECK, JR.

*Attesting Officer*

*Commissioner of Patents and Trademarks*